US006388197B1

(12) United States Patent
Zhao et al.

(10) Patent No.: US 6,388,197 B1
(45) Date of Patent: May 14, 2002

(54) CORONA PROTECTION DEVICE OF SEMICONDUCTIVE RUBBER FOR POLYMER INSULATORS

(75) Inventors: Tiebin Zhao, Medina, OH (US); Jeffrey Kester, Bemus Point, NY (US); John A. Krause, Medina, OH (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/534,240

(22) Filed: Mar. 23, 2000

(51) Int. Cl.[7] ..... H01B 17/42
(52) U.S. Cl. ..... 174/140 CR
(58) Field of Search ..... 174/1, 2, 127, 174/140 CR, 140 H, 140 R, 140 S, 141 C, 141 S, 141 R, 144, 150

(56) References Cited

U.S. PATENT DOCUMENTS

| | | | | | |
|---|---|---|---|---|---|
| 2,835,725 | A | * | 5/1958 | Nicholas | 174/144 |
| 3,192,312 | A | | 6/1965 | Sauer | 174/209 |
| 3,735,019 | A | | 5/1973 | Hess et al. | 174/31 R |
| 3,828,116 | A | * | 8/1974 | Lonow | 174/127 |
| 3,836,705 | A | | 9/1974 | Rosenblatt | 174/140 C |
| 3,930,113 | A | * | 12/1975 | Johansen et al. | 174/127 |
| 3,941,918 | A | | 3/1976 | Nigol et al. | 174/140 C |
| 4,103,103 | A | | 7/1978 | Hizikata | 174/140 C |
| 4,198,538 | A | * | 4/1980 | Lusk | 174/140 S |
| 4,343,966 | A | | 8/1982 | Pargamin | 174/140 S |
| 4,355,200 | A | * | 10/1982 | Wheeler et al. | 174/140 S |
| 4,443,659 | A | | 4/1984 | Tatem | 174/140 C |
| 4,724,284 | A | | 2/1988 | Wheeler | 174/152 R |
| 5,216,570 | A | * | 6/1993 | Yorozuya et al. | 174/140 R |
| 5,336,852 | A | * | 8/1994 | Goch et al. | 174/140 CR |
| 5,552,566 | A | * | 9/1996 | Lin et al. | 174/144 |
| 5,705,775 | A | * | 1/1998 | Ishihara et al. | 174/140 CR |
| 5,796,048 | A | * | 8/1998 | Suzuki et al. | 174/141 C |
| 5,903,427 | A | * | 5/1999 | Roby | 174/140 R |
| 6,075,209 | A | * | 6/2000 | Luzzi | 174/140 R |

* cited by examiner

*Primary Examiner*—Dean A. Reichard
*Assistant Examiner*—Adolfo Nino
(74) *Attorney, Agent, or Firm*—Jeffrey J. Howell; Mark S. Bicks; Alfred N. Goodman

(57) ABSTRACT

A high voltage insulator has a fiberglass reinforced core surrounded by a polymer weathershed housing with a plurality of fins. Metal fittings are located at both ends of the insulator and are connected to the weathershed housing by shielding collars. A corona protection device of semiconductive elastomeric material is attached or bonded to the exterior of the shielding collar or the metal fitting. The interface between the corona protection device and the shielding collar or metal fitting may include a sealant or other compound.

19 Claims, 2 Drawing Sheets

CORONA PROTECTION DEVICE OF SEMICONDUCTIVE RUBBER FOR POLYMER INSULATORS

FIELD OF INVENTION

The present invention relates to electrical polymer insulators with exterior semiconductive elastomeric corona protection devices. A corona protection device is attached or bonded to the insulator and is used to protect the insulator from polymer housing deterioration and to eliminate television and radio interference because of noise created by corona.

BACKGROUND OF THE INVENTION

Electrical polymer insulators are used in power transmission and distribution systems to provide mechanical support for the conductors and provide electrical insulation between the high voltage conductors and grounded tower structures. A corona protection device is located at the line end and/or the ground end of the insulator and eliminates the corona discharge from the insulator. Elimination of the corona discharge protects the surface of the insulator from polymeric material deterioration caused by electric stress. In addition, eliminating the corona discharge reduces television and/or radio noise created by the corona discharge.

Present day corona protection devices are generally made of a metal, such as aluminum. These metal corona protection devices have a tendency to be mishandled during shipping and/or installation. Mishandling, such as dropping or striking the protection device against another object, causes mechanical damage to the corona protection device due to the rigid nature of the metal. This damage alters the shape of the corona protection device, which can result in a reduction in the protection device's ability to eliminate a corona discharge.

In order for a corona protection device to operate properly, it must be in its original configuration. When the corona protection device is damaged due to mishandling the corona discharge may not be eliminated and polymeric material deterioration and radio and television noise are likely.

Examples for prior electrical insulators are U.S. Pat. Nos.: 3,192,312 to Sauer; 3,735,019 to Hess et al; 3,836,705 to Rosenblatt; 3,941,918 to Nigol et al; 4,103,103 to Hizikata; 4,343,966 to Pargamin; 4,443,659 to Tatem; 4,724,284 to Wheeler.

A need thus exists to overcome the inherent problems of the existing prior art, while maintaining the desired result of eliminating a corona discharge on an electrical insulator device.

SUMMARY OF THE INVENTION

Accordingly, an object of the present invention is to provide an electrical polymer insulator, particularly for power transmission and distribution systems, with a corona protection device that reduces polymeric material deterioration on the surface of the polymer insulator by eliminating the corona discharge.

Another object of the present invention is to provide an electrical polymer insulator with a corona protection device that will reduce television and radio interference or noise by eliminating the corona discharge.

A further object of the present invention is to provide an electrical polymer insulator with a corona protection device that is made of semiconductive elastomeric material, which would reduce or prevent possible damage to the device due to mishandling, thus saving possible maintenance time.

Yet another object of the present invention is to provide an electrical polymer insulator with a corona protection device that is made of semiconductive elastomeric material that eliminates costly metal materials for metal corona rings, which may reduce the cost of the device and insulator.

Yet another object of this invention is to provide an electrical polymer insulator with a corona protection device made of a semiconductive elastomeric compound that is resistant to weather, ultra-violet radiation, and electrical surface discharges.

Still another object of this invention is to provide a corona protection device that may vary in thickness and diameter, allowing a reduction in cost in the manufacturing of the protection device and also allowing a reduction in size, while still eliminating the corona discharge.

The foregoing objects are basically obtained by providing a polymer insulator with a fiberglass reinforced core and metal fittings at both ends of the core. A polymer weathershed housing surrounds the core with each end of the weathershed housing abutting one of the metal fittings. The weathershed housing is sealed to the end fittings through the use of metal shielding collars that overlap the end of both the weathershed housing and the metal fittings. A semiconductive elastomeric corona protection device is molded and bonded to the exterior of the polymer insulator end fittings.

The protection device may be molded to the metal fittings, the shielded collars or a portion of both the metal fittings and the shielding collars. The semiconductive rubber corona protection device eliminates the corona discharge emitted from the polymer insulator end fittings and is not likely to be damaged when it is shipped or installed due to the resilient nature of the elastomeric material.

Other objects, advantages and salient features of the invention will become apparent from the following detailed description, which when taken in conjunction with the annexed drawings, discloses a preferred embodiment of the invention.

BRIEF DESCRIPTION OF THE DRAWINGS

Referring to the drawings which form a part of this disclosure.

DETAILED DESCRIPTION OF THE PREFERRED EMBODIMENT

Figure 1:
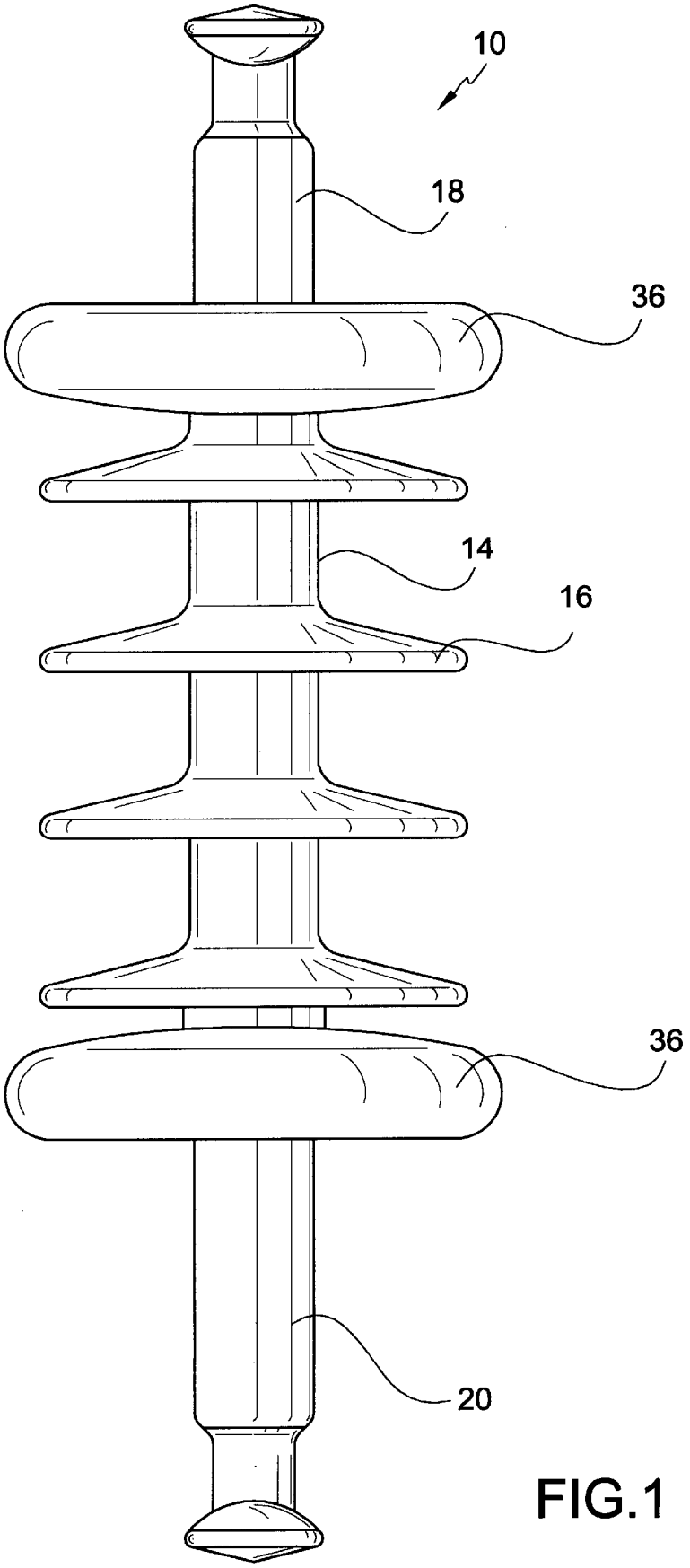
FIG. 1 is a side elevational view of a polymer insulator in accordance with a first embodiment of the present invention.
Figure 2:
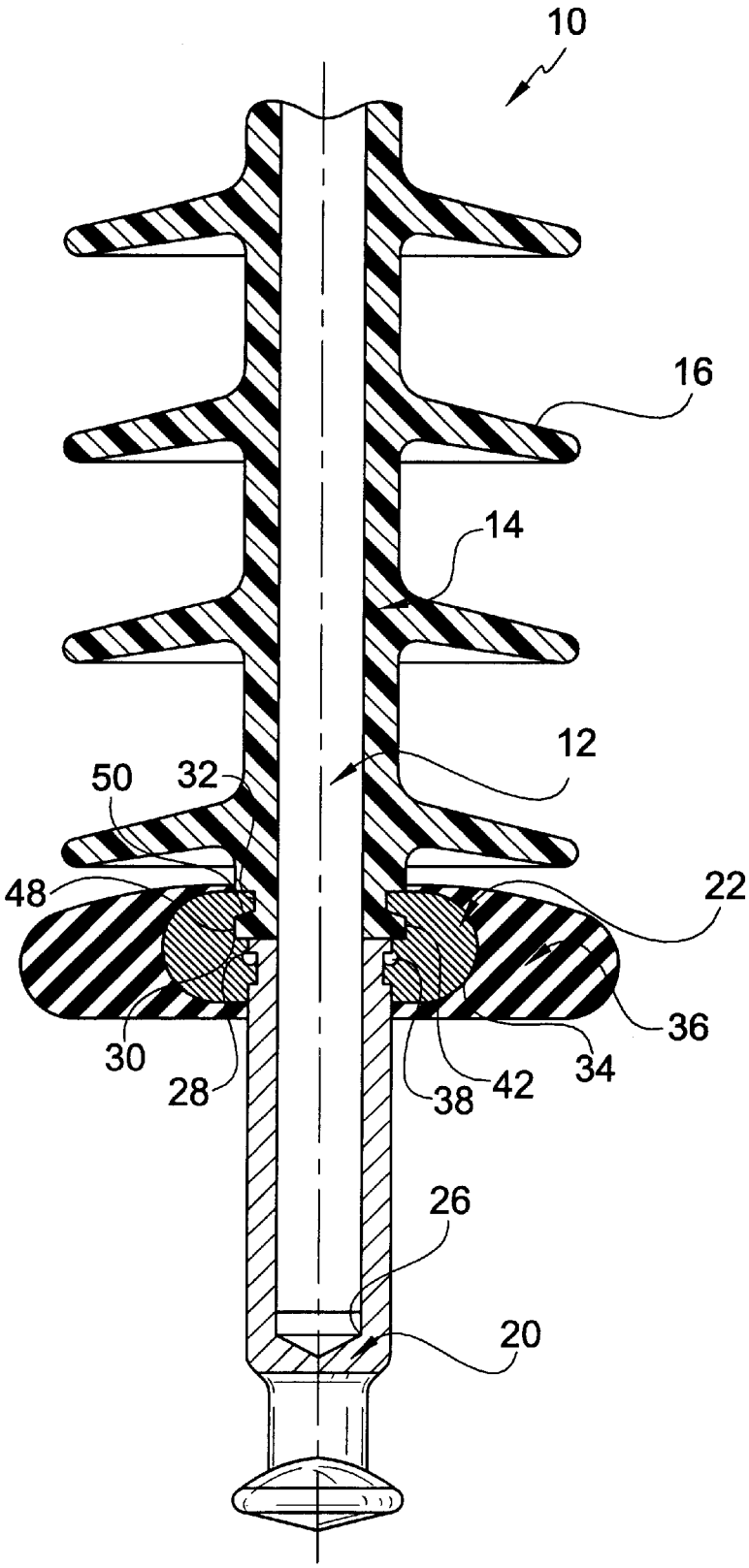
FIG. 2 is a partial, side elevational view in cross section of the insulator of FIG. 1.

Referring initially to FIGS. 1 and 2, polymer insulator 10, according to a first embodiment of the present invention is formed from a core 12, surrounded by an external polymer weathershed housing 14. The weathershed housing has a plurality of polymer fins 16 that extend laterally from the housing. At each end of core 12, end fittings 18 and 20 fit over and cap respective ends of core 12. End fittings 18 and 20 are attached to weathershed housing 14 by cylindrical shielding collars, such as shielding collar 22, shown in FIG. 2. Molded and bonded to the external surface of the shielding collars and the fittings is corona protection device 36, which may be attached to the line end, the ground end, or both, as depicted in FIG. 1.

Preferably, core 12 is cylindrical and extends co-axially along the longitudinal axis of the insulator. It is reinforced with a composite material that has a high tensile strength, such as fiberglass.

Weathershed housing 14 is an external housing that is adjacent to, completely surrounds, and forms an interference fit with the core 12. It may be made from any resilient polymer and is cylindrical in nature. Typically, the weathershed housing has a plurality of disc shaped polymer fins 16 that extend from and surround the housing. The polymer fins 16 are arranged equidistant from one another and serve to lengthen the leakage path and help protect the insulator from damage.

Because each metal end fitting and shielding collar is identical in nature, only fitting 20 and its shielding collar 22 are described in detail. End fitting 20 is a cylindrical metal tube that is closed at end 26 and open at end 28. It slides over the end of core 12, and surrounds and caps the core.

Shielding collar 22 is a one-piece metal cylindrical hollow tube with openings at both ends. The shielding collar slides over metal fitting 20 and is coupled to the metal fitting through fastener 38. Fastener 38 is a short threaded bolt that is threaded into a hole drilled through shielding collar 22. Fastener 38 abuts metal fitting 20, applying pressure and holding shielding collar 22 and corona protection device 36 in place. Shielding collar 22 may be held with more than one fastener of this type. In addition, it may be necessary to design the mold for corona protection device 36 with a hole to access fastener 38 with a wrench.

Weathershed housing 14 extends between collar 22 and core 12, and is latched to collar 22 through annular groove 32 and annular lip 42 on weathershed housing 14 and matching annular groove 48 and annular lip 50 on shielding collar 22. Since weathershed housing 14 is made of elastomeric material it is able to slide between core 12 and shielding collar 22. Annular lip 42 locks with annular groove 32 and annular lip 50 locks with annular groove 48 preventing weathershed housing 14 from sliding along core 12. Open end 28 of fitting 20 abuts lower free end 30 of the weathershed housing 14. Shielding collar 22 overlaps the end 30 of weathershed housing 14 and the end 26 of metal fitting 20 and couples and seals the weathershed housing and the fitting together.

As shown in FIG. 2, corona protection device 36 is molded and bonded to the shielding collar 22 and the metal fitting 20. Preferably, corona device 36 is simultaneously molded and bonded into a cylindrical tube, open at both ends, to surround the shielding collar 22 and/or the metal fitting 20 before they are installed onto insulator 10. However, it is possible that the corona protection device can be attached to the shielding collar or the metal fitting after they are installed onto the insulator.

Corona protection device 36 is made from a semiconductive rubber or other elastomeric material whose electrical properties are consistent with the resistivity levels required to eliminate a corona discharge. The semiconductive rubber may be any kind of semiconductive compound, as long as it incorporates adequate carbon black loading. Adequate carbon black loading results in a resistivity value of the compound covering a wide range, with a preferred value of $10^7$ ohm-cm or less.

Additionally, the mechanical properties of the elastomeric material must allow for flexibility and resistance to weather, ultra-violet radiation and electrical surface discharges. These mechanical properties enable corona device 36 to help reduce maintenance costs by resisting the weather elements and by reducing possible permanent or rigid damaging when subjected to a mechanical load.

The corona protection device 36 may also vary in thickness, diameter and shape without a major reduction in its ability to eliminate a corona discharge. Differing shapes may serve to reduce the electric stress in the nearby areas in air, or on the surface of the polymeric materials of the housing or the metal end fittings or the polymeric materials. This allows the corona protection device to vary in cost dependant on its material and size. Thus, permitting a less expensive smaller product with substantially the same effectiveness compared to present day conventional metal corona protection devices.

The bond between the corona protection device 36 and the shielding collar 22 and/or the metal end fitting 20 should be of sufficient strength to prevent separation of corona protection device 36 from shielding collar 22 when insulator 10 is dropped or struck against another surface. Any known chemically adhesive bonding agent for bonding rubber and metal may form the bond between the shielding collar 22 and corona protection device 36 as long as it has conductive properties and can sustain the mechanical load requirements. The bonded interface 34 between the corona protection device 36 and the collar 22 may include a sealant or other compound.

The corona protection device may be molded to the shielding collar alone, the metal fitting alone, or the protection device may overlap a portion of both the shielding collar and the metal fitting as shown in FIG. 2.

While one embodiment has been chosen to illustrate the invention, it will be understood by those skilled in the art that various changes and modifications can be made therein without departing from the scope of the invention as defined in the appended claims.

What is claimed is:

1. An electrical insulator, comprising:

a core;

a metal fitting located at an end of said electrical insulator;

an external weathershed housing surrounding said core;

a shielding collar coupling said weathershed housing to said metal fitting; and a resilient corona protection member formed from a semiconductive elastomeric material coupled to a radially outwardly facing exterior surface of said shielding collar.

2. An electrical insulator of claim 1 wherein said core is fiberglass reinforced.

3. An electrical insulator of claim 1 wherein said weathershed housing is made from a polymer.

4. An electrical insulator of claim 1 wherein said resilient corona protection member is coupled to an exterior of said metal fitting.

5. An electrical insulator of claim 1 wherein said corona protection member is coupled to an exterior of said metal fitting.

6. An electrical insulator of claim 1 wherein said elastomeric material is semiconductive through carbon black loading.

7. An electrical insulator of claim 1 wherein said semiconductive elastomeric material is weather resistant.

8. An electrical insulator of claim 1 wherein said semiconductive elastomeric material is ultra-violet radiation resistant.

9. An electrical insulator of claim 1 wherein said semiconductive elastomeric material is resistant to electrical surface discharges.

10. A high voltage insulator, comprising;

a fiberglass reinforced core;

a metal fitting located at one end of said high voltage insulator;

an external polymer weathershed housing adjacent to and surrounding said core;

a plurality of polymer fins extending from said weathershed housing;

a shielding collar coupling said weathershed housing to said metal fitting; and a semiconductive elastomeric corona protection mechanism molded to a radially facing exterior surface of said high voltage insulator.

11. A high voltage insulator of claim 10 wherein an interface between said corona protection mechanism and high voltage insulator includes a sealant.

12. A high voltage insulator of claim 11 wherein said corona protection mechanism is molded to an exterior of said shielding collar.

13. A high voltage insulator of claim 11 wherein said corona protection mechanism is molded to an exterior of said metal fitting.

14. A high voltage insulator of claim 11 wherein said corona protection mechanism is molded to an exterior of said shielding collar and an exterior of said metal fitting.

15. A high voltage insulator of claim 10 wherein said corona protection material is resistant to weather, ultra-violet radiation, and electrical surface discharges.

16. A polymer insulator comprising:

a fiberglass reinforced cylindrical insulator core extending coaxially along a longitudinal axis;

an external polymer weathershed housing adjacent to and surrounding said core;

a plurality of disc shaped polymer fins extending from said weathershed housing and arranged equidistant from one another;

a first metal fitting attached to a proximal end of said core, said first metal fitting having inner and outer ends;

a second metal fitting attached to a distal end of said core, said second metal fitting having inner and outer ends, said inner ends of said first and second metal fittings abutting opposing ends of said weathershed housing;

a first cylindrical metal shielding collar sealably coupling said weathershed housing to said first metal fitting;

a second cylindrical metal shielding collar sealably coupling said weathershed housing to said second metal fitting;

a first cylindrical semiconductive elastomeric corona protection member bonded to, sealed to, and surrounding at least a portion of said first shielding collar; and a second cylindrical semiconductive elastomeric corona protection member bonded to, sealed to, and surrounding at least a portion of said second shielding collar.

17. A polymer insulator according to claim 16 wherein said first and second corona protection members are bonded and sealed about said first and second metal shielding collars.

18. A polymer insulator according to claim 16 wherein said first and second corona protection members are bonded and sealed about said first and second metal fittings.

19. A polymer insulator according to claim 16 wherein said first and second corona protection members are bonded and sealed about said first and second metal shielding collars and said first and second metal fittings.

* * * * *